United States Patent [19]

Walters

[11] 4,120,183

[45] Oct. 17, 1978

[54] LOCK ASSEMBLY FOR HIGH SECURITY CONTAINER

[75] Inventor: Russell W. Walters, Richmond, Ky.

[73] Assignee: BMR Security Products Corp., Richmond, Ky.

[21] Appl. No.: 707,627

[22] Filed: Jul. 22, 1976

[51] Int. Cl.[2] ..... B65D 55/14

[52] U.S. Cl. ..... 70/159; 70/461

[58] Field of Search ..... 292/256, 256.5, 302, 292/145, DIG. 11, DIG. 53, DIG. 55, DIG. 60, 341.18, 341.19; 70/158, 159, 160–164, 7, 8, 177, 199, 202, 211, 246, 461, DIG. 34

[56] References Cited

U.S. PATENT DOCUMENTS

| | | | |
|---|---|---|---|
| 1,351,117 | 8/1920 | Newhall | 292/302 |
| 1,675,155 | 6/1928 | Bremer | 292/341.19 |
| 1,944,535 | 1/1934 | White | 70/159 |
| 2,275,760 | 3/1942 | Hoffman | 292/341.19 |
| 2,825,218 | 3/1958 | O'Brien | 70/8 |
| 4,023,386 | 5/1977 | Walters | 70/164 |

*Primary Examiner*—Kenneth J. Dorner
*Attorney, Agent, or Firm*—Frailey & Ratner

[57] ABSTRACT

A lock assembly having a lock housing which is secured to a first member such as a lid or door of a locker or other container. The lock housing includes a bar lock accessible at a first end portion, a second end portion, a continuous top portion and a continuous first side portion. The bottom portion is provided with an opening into which a strike may be introduced for engagement by the bar lock and the lock housing covers and conceals the strike. The strike is adjustably and releasably secured to the locker so that the mutual positional relation between the strike and the lock housing may be altered.

15 Claims, 7 Drawing Figures

FIG. 4
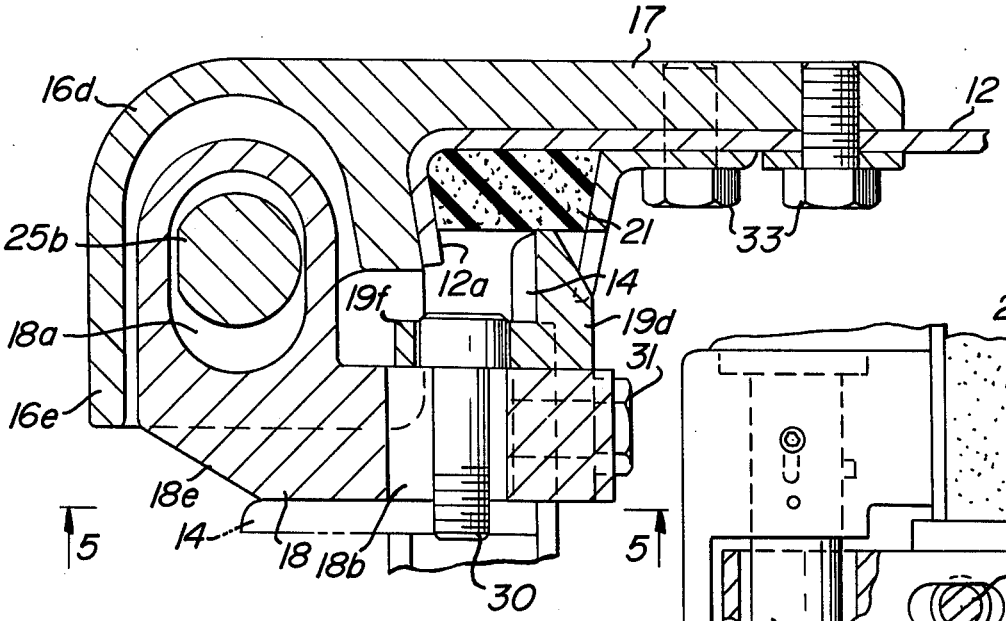
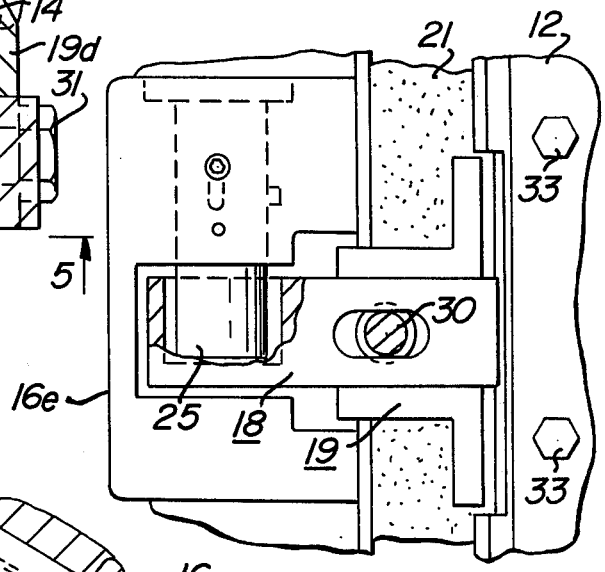
FIG. 5
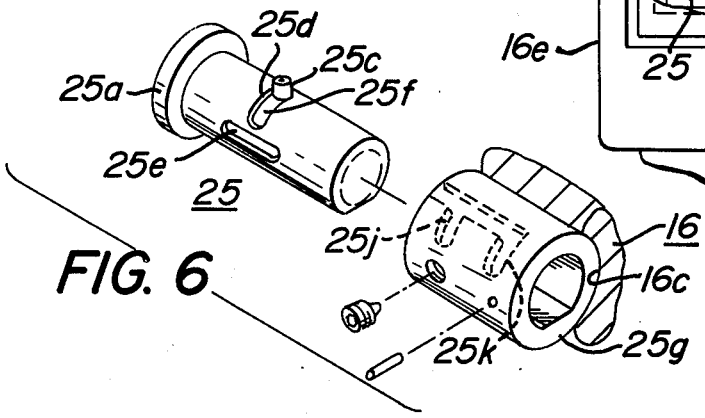
FIG. 6
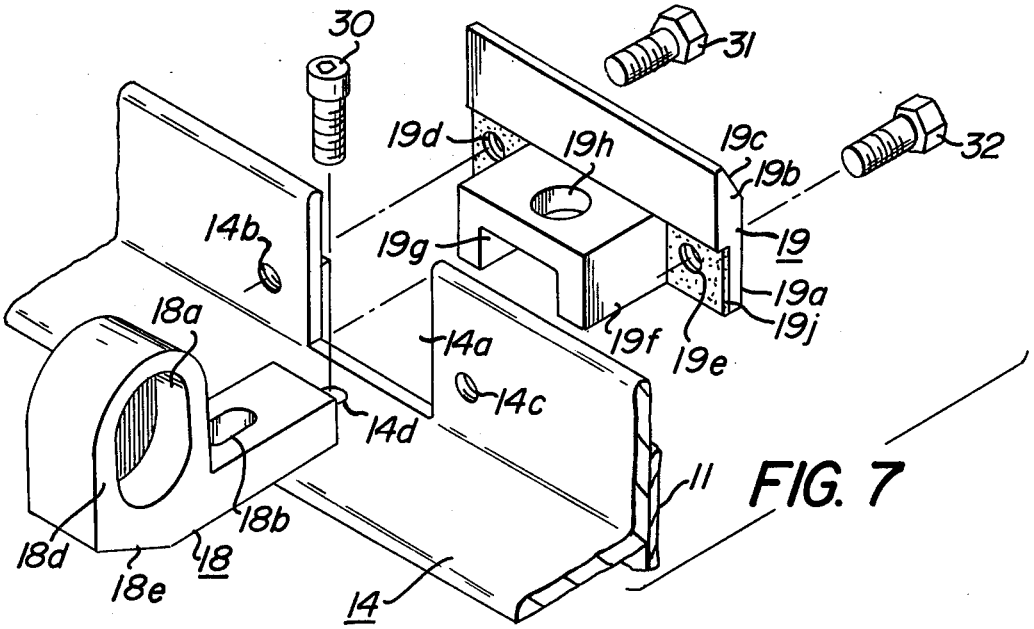
FIG. 7

LOCK ASSEMBLY FOR HIGH SECURITY CONTAINER

BACKGROUND OF THE INVENTION

A. Field of the Invention

This invention pertains to locking systems and has particular pertinence to locking systems for containers for items that require high security.

B. Prior Art

There are a number of instances in which it is extremely important to contain certain high security items in theft-resistant circumstances. One such instance is found in the Navy wherein naval vessels have lockers for products such as armaments, shotguns, flares, lantern lights, etc. These lockers are located on the upper decks of the vessel, and therefore should be air-tight and water-tight to prevent rusting or other harmful effects of the sea atmosphere. These lockers have a horizontal lid or door which is placed atop the locker and is maintained in tight contact therewith by the use of toggles between the sides of the locker and the lid. At one end of the locker, the lid is hinged to the locker and at the other end the locker has been secured by more or less conventional locks. However, such prior art locks have not proved sufficiently resistant to being forced open or did not permit the lid to be secured sufficiently tightly to the locker, or did not afford the necessary degree of adaptability for use on some lockers whose dimensions were not within prescribed tolerances.

SUMMARY OF THE INVENTION

The lock assembly comprises a lock-housing means connected to a means for securing the housing means to a first member such as the lid or door of a locker or other container. The lock-housing means includes a lock accessible at a first end portion, a second end portion, a continuous top portion and a continuous first side portion. It also has a second side portion, and a bottom portion. At least one of the bottom or side portions is provided with an opening into which a second member, such as a strike, may be introduced for engagement by said lock.

BRIEF DESCRIPTION OF THE DRAWINGS

FIG. 4 is a sectional view taken along the lines 4—4 of FIG. 3;

FIG. 5 is a bottom view of part of the apparatus shown in FIG. 4 taken along the lines 5—5 of FIG. 4;

FIG. 6 is an exploded perspective view of the barlock sub-assembly portion of the lock assembly in accordance with the present invention; and FIG. 7 is an exploded perspective view of the strike and strike housing sub-assembly of the locking system herein.

DETAILED DESCRIPTION

Figure 1:
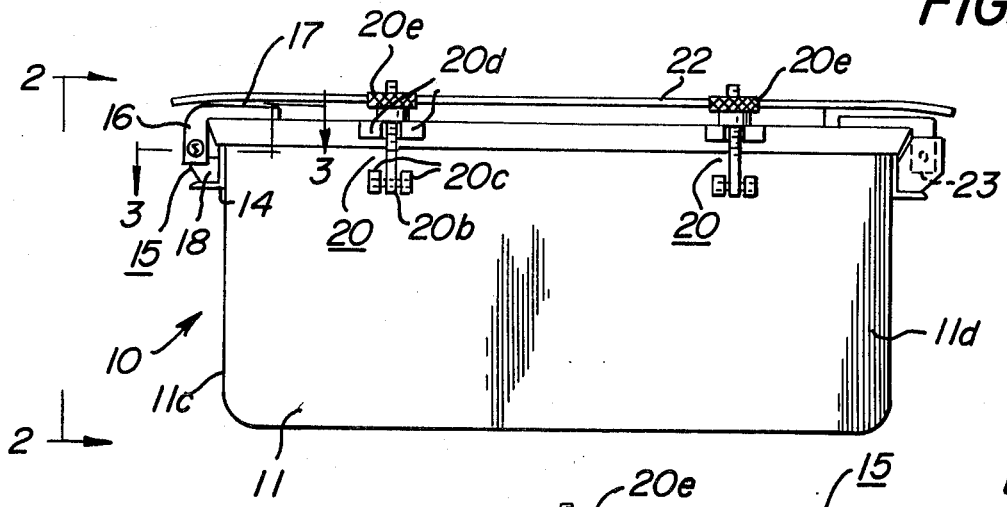
FIG. 1 is a side elevation view of a locker having a lock assembly in accordance with the present invention.
Figure 2:
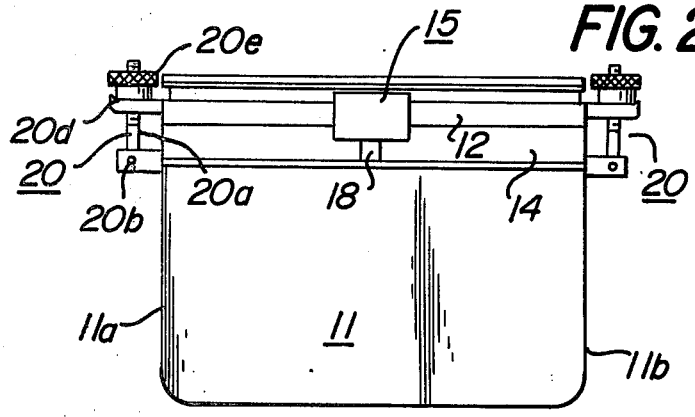
FIG. 2 is a left end elevation view of the locker shown in FIG. 1.
Figure 3:
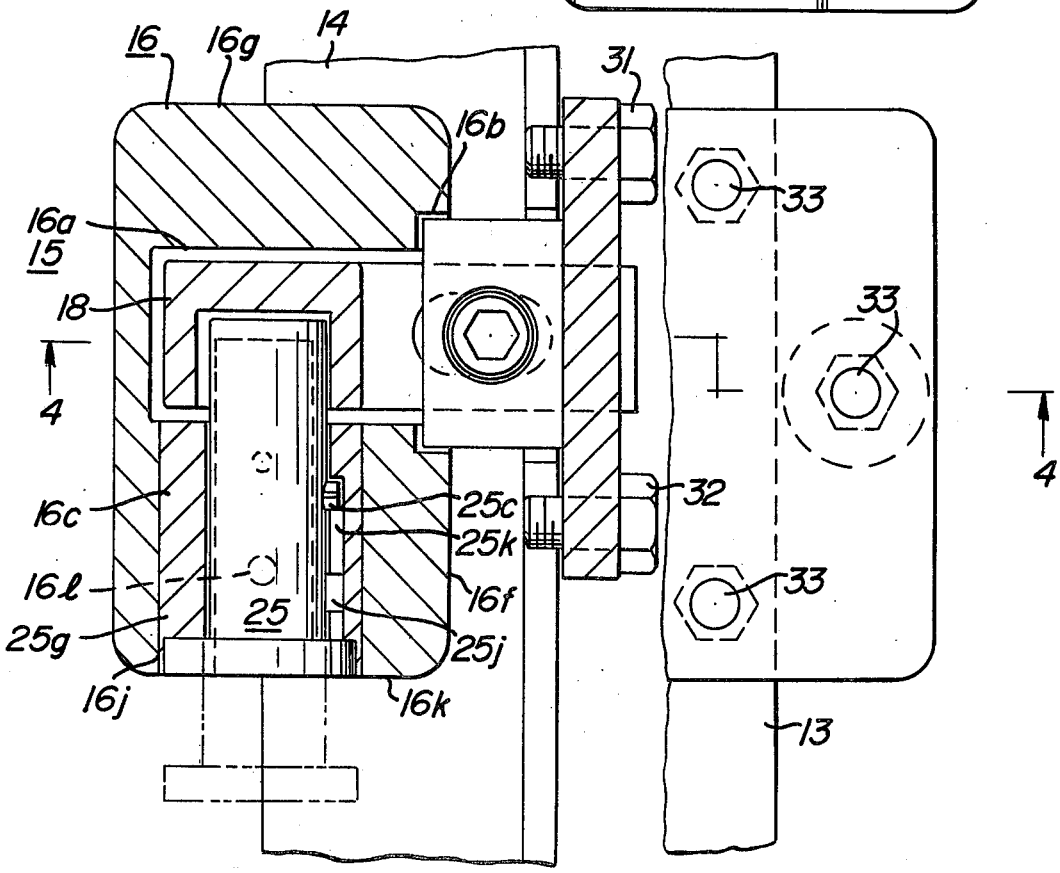
FIG. 3 is a view, partly in section, taken along the lines 3—3 of FIG. 1.

Referring now to FIGS. 1 and 2 in particular, there is shown a deck armament locker assembly indicated generally at the numeral 10. This mechanism comprises a locker container 11 having a horizontal door or lid 12 swingably connected to the locker at one end by hinge(s) 23 and lockable at the other end by the locking assembly indicated generally at the numeral 15. The lid 12 is clamped down to the locker along its sides 11*a* and 11*b* by a plurality of toggle sub-assemblies 20. Each toggle sub-assembly 20 comprises two lower horizontally-projecting elements 20*c* attached to the sides 11*a* or 11*b*, as the case may be, which hold a horizontal pivot pin 20*b*. A vertical threaded bolt member 20*a* has at its lower end a transverse hole through which the pivot pin 20*b* passes enabling the vertical member 20*a* to swing upwardly as shown in FIGS. 1 and 2. It can also pivot outwardly and downwardly when its knurled fastening nut 20*e* is unscrewed out of contact with the two upper laterally-extending projecting members 20*d* whose inner extremities are fastened to the sides 11*a* or 11*b*. Attached to the top of the lid 12 is a sun shield 22 which tends to keep the temperature of the locker 11 from becoming excessively high.

FIGS. 3–7 will now be considered in examining the details of construction of the locking assembly 15. The assembly includes a substantially planar portion 17 which is secured to the lid 12, a lock-housing portion 16 connected to the planar portion 17, and a strike 18 connected to the end 11*c* of the container 11.

The lock-housing 16 contains a key-actuated barlock sub-assembly 25 fitted in an axial bore 16*c* therein. The top 16*d* is continuous and unbroken as is its adjacent side portion 16*e*. Its opposite side portion 16*f* includes an outer opening portion 16*b* communicating with a somewhat smaller passageway 16*a*. This opening portion and passageway permit entrance of the strike into the lock housing 16. Since the door 12 swings downwardly and upwardly, the bottom of the lock housing also has a cut-out portion 16*m* into which the strike may pass. The end portion 16*g* is also continuous and unbroken whereas its opposite end portion 16*h* is broken by a generally circular opening portion 16*j* which communicates with a smaller diameter bore 16*c*. The opening 16*j* and bore 16 accommodate a sleeve or liner 25*g* which is retained in the housing 16 by retaining pin 16*k* passed through aligned apertures in the bottom 16*m* and in the sleeve 25*g*. The lock bar subassembly 25*a* fits within the sleeve 25*g* and cooperates therewith so as to be movable axially when its key is turned. This interaction also permits the lock bar to be maintained either in an outer disengaged position or in an inner strike-engaging position as will be explained below. The tube 25*b* includes a groove 25*e* which is engaged when it is fully within sleeve 25*g*, by a set screw 16*l* which is screwed into a threaded aperture in the bottom portion 16*m*.

The planar, unbroken securing portion 17 is fixed to the lid 12 by bolts 33 passing upward through apertures formed in the lid and in beam 13. At its outer edge on all sides, the lid 12 has a bent-down portion 12*a* which, together with beam 13 secured to the door 12 by some of the bolts 33, confines a plastic or other deformable gasket 21. Thus, when the toggle subassemblies 20 are screwed down as shown in FIGS. 1 and 2, they bring the gasket 21 increasingly downward against the top of the L-sectioned beam 14 as well as the upper edge of strike housing portion 19*b*. The same arrangement exists on the other sides and end thereby insuring an air-tight and weather-tight seal of the contents of the locker 11.

Bar Lock Subassembly

The bar lock 25 assembly comprises a tube 25*b* having a flange 25*a*, a longitudinally oriented groove or depression 25*e*, and a transverse opening 25*d* through which a laterally movable pin 25c attached to the inner plug 25f projects. The tube 25b fits within the sleeve 25g with its pin 25c protruding either through longitudinal slot 25h or in either of two substantially parallel transverse slot 25j and 25k communicating therewith. The outermost transverse slot 25j is the one which enables the bar lock to be kept in its outer, unlocked position when the key has been turned and the pin 25c is slid outwardly along slot 25h until it intersects slot 25j. The inner transverse slot is the one that maintains the lock in its innermost, locked position when engaged by pin 25c. The action of lock bar 25 is quite similar to the lock bar shown in FIG. 2 of my U.S. Pat. No. 3,921,422 issued Nov. 25, 1975.

Adjustable Stike Subassembly

The strike housing-strike subassembly 18, 19 is constructed to allow the lock system to be used with containers having lids which may not be within prescribed tolerances. Its adjustability suits cases in which the lid and the locker are intended to be somewhat flexible in their mutual positional relation so that the strike subassembly may be moved a bit to conform to the geometry, the dimensions or the placement of the lock-housing assembly.

The strike housing 19 is bolted to the L-sectioned angle member 14 by bolts 31 and 32 passing through apertures 19d and 19e of housing 19 and aligned apertures 14b and 14c in the beam 14, the latter pair of apertures being threaded. Perforated compression seals 19j are provided opposite the smaller width portions 19a. The wider upper portion 19b has its lower end contiguous to the upper edge of the end portion 11c of the locker and its vertical flat portion 19k in contact with the internal vertical surface of the beam 14.

The strike housing 19 also includes a generally inverted-U-shaped projection 19f attached to, or formed integrally with the inner surface of the portion 19a. The cross-section of the central channel 19g is substantially the same as the cross-section of the portion 18c of the strike. The strike portion 18c is moved in channel 19g until it extends outwardly from the angle 14 the desired distance. The upper horizontal flat portion is provided with an aperture 19h through which a vertical adjusting bolt 30 may be passed when the desired position of the strike 18 in the channel 19g has been effected. The bolt 30 passing through aperture 19h and elongated opening 18b screws into the threaded aperture 14d in the beam 14 to fix the strike position.

The strikes has a hollowed-out portion 18a which is generally oval or ellipsoidal in cross-section, its long axis being vertical. This portion 18a allows a certain amount of play between the lock bar or bolt 25b when it is in the innermost position. The width of the portion 18a is somewhat larger than the cross-section of the bolt 25b. The dimensions of portion 18a allow for differences in the vertical positioning of the lid 12 depending upon, for example, the state of compression of the gasket 21 due, in turn, to the tightness of the toggles 20. The dimensions of passageway portions 16b and 16a are also somewhat larger than the strike housing portion 19f and strike portion 18d respectively to allow for the horizontal and vertical adjustability.

What is claimed is:

1. A lock assembly comprising:

(a) means for securing said assembly to a member, and (b) lock housing means connected to said securing means, said lock housing means having, (i) a continuous top portion, (ii) a continuous first side portion adjacent said top portion, (iii) a second side portion opposite said first side portion, (iv) a first end portion, (v) a substantially cylindrical sleeve portion, (vi) a bar lock extendible in its longitudinal direction within said sleeve portion of said lock-housing means and when said assembly is in the locked condition said bar lock is accessible for unlocking only at said first end portion, said bar lock being capturable within said sleeve portion, (vii) a second end portion which has a continuous unbroken surface, (viii) a bottom portion opposite said top portion, said bottom portion being provided with an opening into which strike means may be introduced for engagement by said bar lock and said lock housing means covering and concealing said strike means except through said bottom portion opening.

2. The lock assembly according to claim 1 in which said strike means includes a strike housing secured to an additional member whereby said first named member and said additional member are moved one with respect to the other to gain access to a locked area upon disengagement of said bar lock from said strike means, said lock housing means being nonpivotable with respect to said first named member for all positions of said lock housing means.

3. The assembly according to claim 1 wherein said means for securing said housing to said first named member is an extension of said continuous top portion and has a substantially continuous and unbroken outer surface.

4. The lock assembly according to claim 3 wherein said extension is a substantially planar member and adapted to be secured in a substantially parallel relation to said first named member.

5. The lock assembly according to claim 4 wherein said opening has a substantially quadrilateral contour.

6. The lock assembly according to claim 1 wherein said bottom portion has a substantially flat surface.

7. The lock assembly of claim 2 in which said strike means includes a strike adjustably and releasably secured to said strike housing.

8. The lock assembly according to claim 7 wherein said strike is movable transversely of said longitudinal direction thereby to adjust its position relative to said strike housing.

9. The lock assembly according to claim 8 wherein said strike has a hollowed-out portion having a substantially ellipsoidal cross-section for receiving said bar lock, the major axis of said hollowed-out portion being substantially vertical.

10. The lock assembly of claim 8 in which said lock housing means has a unitary lock housing and said continuous top portion overlies and extends above said strike.

11. The lock assembly of claim 10 in which said strike has a substantially continuous dimension in said longitudinal dimension of said bar lock.

12. The lock assembly of claim 2 in which said strike means includes a strike having an opening for receiving said bar lock.

13. The lock assembly according to claim 1 wherein said opening is provided also in said second side portion.

14. The lock assembly according to claim 13 wherein said opening formed in said second side portion is dimensioned to be larger than the width of said strike means.

15. The lock assembly according to claim 13 wherein said strike means includes a strike housing attachable to a fixed point and a strike adjustably and releasably secured to and extendible through said second side portion opening of said strike housing.

* * * * *